US005239729A

United States Patent [19]

Scholl

[11] Patent Number: 5,239,729

[45] Date of Patent: Aug. 31, 1993

[54] REMOVABLE HINGE ASSEMBLY FOR WASTE CONTAINERS AND THE LIKE

[76] Inventor: Leonard M. Scholl, 5751-A Palmer Way, Carlsbad, Calif. 92008

[21] Appl. No.: 896,408

[22] Filed: Jun. 10, 1992

[51] Int. Cl.[5] ..... E05D 7/10

[52] U.S. Cl. ..... 16/257; 16/231; 16/355

[58] Field of Search ..... 16/231, 232, 355, 356; 220/263, 404

[56] References Cited

U.S. PATENT DOCUMENTS

| | | | |
|---|---|---|---|
| 2,799,324 | 7/1957 | Anderson | 16/231 |
| 4,279,357 | 7/1981 | Robinson | 320/318 |
| 4,550,440 | 10/1985 | Rico | 383/33 |
| 4,913,308 | 4/1990 | Culbertson | 220/404 |
| 4,925,056 | 5/1990 | McCoig | 220/404 |
| 4,979,266 | 12/1990 | Roy | 16/355 |
| 5,048,712 | 9/1991 | Wolters | 220/262 |

*Primary Examiner*—W. Donald Bray

*Attorney, Agent, or Firm*—Brown, Martin, Haller & McClain

[57] ABSTRACT

A removable hinge assembly for pivotally securing a lid to the rim of a receptacle opening has a first hinge member for securing to a lid and a second hinge member with at least one U-shaped spring clip for releasable snap engagement over the rim of the opening with an inner leg positioned on the inside of the receptacle and an outer leg positioned on the outside of the receptacle. A hinge joint pivotally connects the outer leg to the first hinge member.

11 Claims, 1 Drawing Sheet

REMOVABLE HINGE ASSEMBLY FOR WASTE CONTAINERS AND THE LIKE

BACKGROUND OF THE INVENTION

The present invention relates generally to hinge assemblies for hinging a door or lid to one side of an access opening such as a doorway or receptacle opening, and is particularly concerned with a hinge assembly for anchoring a lid to a waste receptacle or the like.

Waste receptacles or bins for disposal of items of trash or the like often have lids which are hinged to the container opening. However, removable plastic liners are commonly used in such containers for easy disposal of collected trash. The hinge must therefore be positioned so that it does not interfere with placement of a bag over the rim of the receptacle. Also, lids must sometimes be removably hinged to the receptacle both to allow for bag insertion and removal and also to allow both the waste receptacle and lid to be cleaned and sterilized effectively. This is particularly important in certain areas, such as hospitals, medical facilities, and catering facilities, where the maintenance of a clean and sterile environment is particularly important.

Removable hinge assemblies proposed in the past for waste receptacles have typically been complicated, difficult to remove and replace, and relatively expensive.

SUMMARY OF THE INVENTION

It is an object of the present invention to provide a new and improved hinge assembly for a waste receptacle or the like.

According to the present invention, a hinge assembly is provided which comprises a first hinge member for securing to one edge of a lid, a second hinge member having at least one generally U-shaped spring clip for snap engagement over the rim of a waste receptacle, and a hinge joint pivotally connecting one leg of the spring clip to the first hinge member.

Preferably, the one leg of the spring clip to which the first hinge member is hinged is longer than the other leg to form an extended back plate which rests against the outside wall of the receptacle to hold the hinge against rotation. With this arrangement, a bag may be placed over the rim of the receptacle and the spring clip or may be installed over the rim and the clip snapped over both the bag and receptacle.

In one preferred embodiment of the invention, the second hinge member comprises a pair of spaced spring clips with one leg of each spring clip connected to the corresponding leg of the other spring clip by an extended back plate, and the first hinge member is pivotally secured to the back plate. This provides added stability.

The hinge assembly can be removed easily simply by forcing the spring clips off the rim of the receptacle, allowing the hinge and receptacle to be cleaned and sterilized quickly and easily. Additionally, the relatively simple structure of the hinge makes it easy to clean and sterilize, which is particularly important in applications where hazardous or infectious waste materials are encountered.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
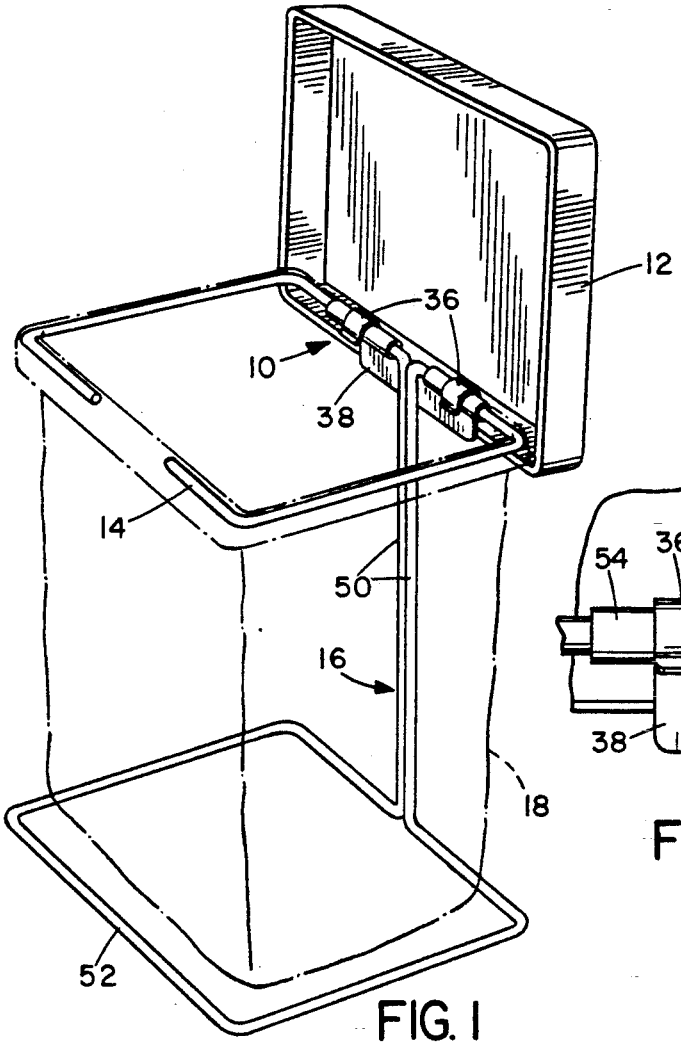
FIG. 1 illustrates a typical waste receptacle frame with a removable hinge assembly according to a preferred embodiment of the present invention.
Figure 3:
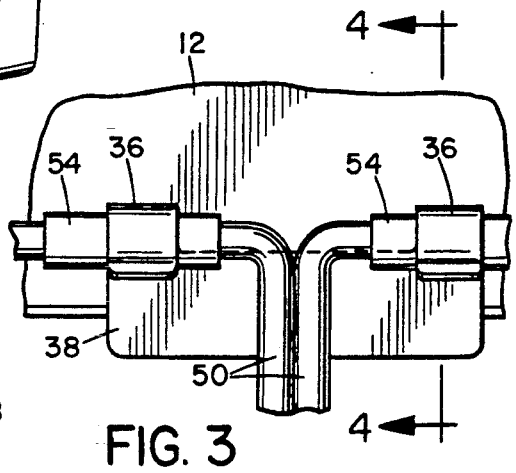
FIG. 3 is an enlarged front view of the hinge assembly mounting.
Figure 4:
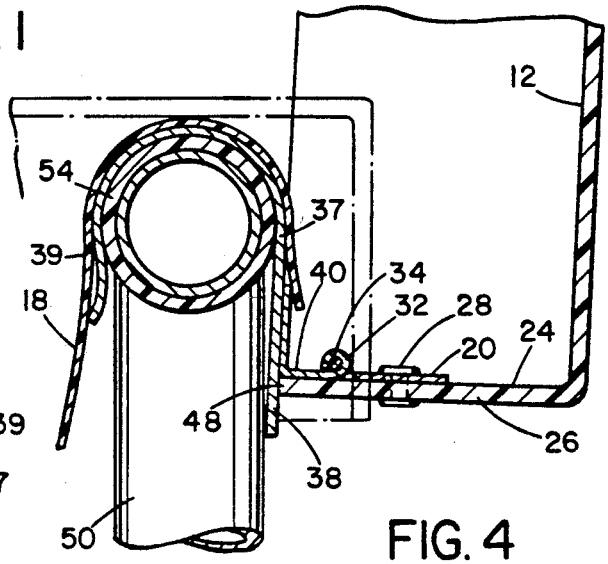
FIG. 4 is an enlarged sectional view taken on line 4—4 of FIG. 3.

The drawings illustrate a hinge assembly 10 for releasably hinging a lid 12 to the rim 14 of a receptacle or tubular receptacle frame 16. In the illustrated embodiment, the receptacle 16 is of the open tubular frame type designed to receive a plastic trash bag 18 with the open end of the bag rolled over the rim 14 of the receptacle, as illustrated in FIGS. 1 and 4. However, it will be understood that the hinge assembly may alternatively be used for hinging a lid to other types of receptacles, including waste bins having solid walls rather than open frame walls.

Figure 2:
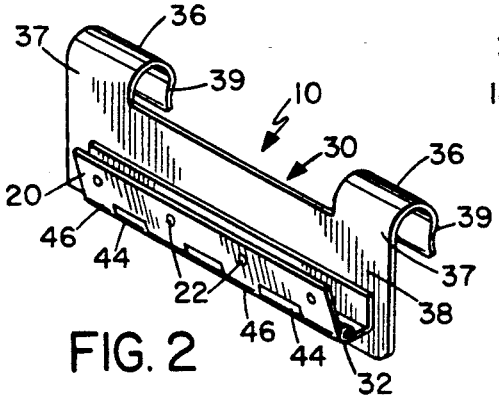
FIG. 2 is a perspective view of the hinge assembly.

As best illustrated in FIGS. 2 and 4, the hinge assembly 10, which is preferably of metal such as stainless steel or the like, includes a first hinge plate or member 20 which has holes 22 for securing it to the inside face 24 of one side wall 26 of the skirt of lid 12 via rivets or the like 28. A second hinge part or member 30 is pivotally connected to hinge plate 20 via hinge joint 32 for rotation about the axis of hinge pin 34. The second hinge member 30 comprises a pair of generally U-shaped spring clips 36, each spring clip having a generally flat outer leg 37 connected to the outer leg of the other clip via integral back plate 38, and a rounded inner leg 39 which provides the spring action. Clearly the shape and dimensions of spring clips 36 will be dependent on the shape and dimensions of the receptacle rim over which they are to be fitted. In the illustrated embodiment, clips 36 are of part-circular shape to snap over a round, tubular rim 14. A generally L-shaped flange member 40 is welded or otherwise secured to the outer face of back plate 38 so that it projects transversely outwardly from the back plate. Knuckles or eyes 44 formed at the free end of flange 40 are interdigitated with corresponding eyes 46 on the first hinge plate 20, and the pivot pin 34 projects through the aligned openings in eyes 44 and 46 to pivotally connect the hinge plate 20 to the hinge member 30.

The first hinge plate 20 is secured to the lid 12 at a predetermined position inset from the lower edge or rim 48 of the lid by a predetermined distance corresponding to the height of flange 40, as best illustrated in FIG. 4. This ensures that when the lid is opened from the closed position illustrated in dotted outline in FIG. 4 to the open position illustrated in solid outline, the lower edge 48 of the lid acts as a stop against the back plate 35 to hold the lid open, leaving the user's hands free.

As best illustrated in FIG. 1, the receptacle is of open framework construction and is formed from a single length of tubing shaped to form the upper square rim of the receptacle, a pair of vertical uprights 50 extending downwardly at the rear of the receptacle, and a lower, rectangular frame 52 defining the bottom wall of the receptacle. The framework may be mounted on caster wheels (not illustrated). As illustrated in FIG. 1, the spring clips are snapped onto the upper rim at the rear of the receptacle so that the back plate spans the uprights 50, resting on the uprights to hold the pivot assembly against rotating on the rim. Protective sleeves 54 of rubber or plastic may be mounted on the tube forming the rim so that it is not damaged by repeated snapping of the clips onto and off the tube. The open end of trash bag 18 can be fitted over the rim above the spring clips, as illustrated in FIGS. 1 and 4, or may be held between the rim and spring clips.

In one particular embodiment of the invention the hinge assembly was designed to snap onto a 1.010 inch diameter tube. In this case, each spring clip had an internal diameter substantially equal to that of the tube, for example around 1.02 inches, with the indented lip at the lower end of the rounded inner leg acting to snap on or off the tube. The width of the back plate was 9 inches while the width of each spring clip was 2 inches. The overall height of the hinge member 30 was 2 inches, and the height of the spring clips alone was 0.75 inches. With the hinge open as in FIG. 4, the distance from the mounting holes 22 to the back plate 30 was 0.75 inches. In order to secure the hinge assembly to a lid, corresponding holes are drilled in the side wall of the lid at a spacing of 0.75 inches from the lower rim of the lid, and the first hinge plate is secured inside the lid as illustrated in FIG. 4.

With this arrangement, trash bags may be installed with their open ends rolled over the top or rim of the receptacle or frame 16 and over the top of the hinge assembly, so that they can be removed and replaced without removing the lid. Alternatively, bags may be installed over the frame rim prior to snapping the clips over the bag and frame rim. In the latter case, the clips will serve to anchor the bag in place. In either case, the lid and hinge can be removed quickly and easily, without requiring any tools, allowing both the receptacle or frame as well as the lid and attached hinge assembly to be thoroughly cleaned and sterilized. This will be advantageous in any receptacle having a hinged lid, but is particularly useful in applications where a sterile environment is required, such as catering, hospital and medical facilities where infectious waste is often encountered.

In the illustrated embodiment, the lid 12 has a solid top wall and downwardly-depending skirt, and must be opened to deposit trash. However, in alternative arrangements, lid 12 may have a cut-out access flap in its top wall to provide a door for depositing trash. In the latter case, the entire lid is opened only for bag replacement.

Another advantage of the hinge assembly is that it provides a stop for automatically supporting the lid in an upright, open position. The back plate joining the spring clips of the hinge also rests against the frame uprights to prevent the hinge from rotating about the circular rod forming the upper rim of the frame in the illustrated embodiment. The hinge assembly is of simple, inexpensive construction and may be used in a large number of different hinge applications.

Although a preferred embodiment of the invention has been described above by way of example only, it will be understood by those skilled in the field that modifications may be made to the disclosed embodiment without departing from the scope of the invention, which is defined by the appended claims.

I claim:

1. A removable hinge assembly for pivotally securing a lid to the rim of a receptacle opening, comprising:

a first hinge member having securing means for securing the hinge member to a lid;

a second hinge member having at least one generally U-shaped spring clip for snap engagement over the rim of a receptacle opening, the spring clip having an inner leg and an outer leg; and a hinge joint pivotally connecting the outer leg of the spring clip to the first hinge member.

2. The assembly as claimed in claim 1, wherein the second hinge member includes a back plate extending downwardly from the outer leg of said spring clip, and the hinge joint is secured to said back plate.

3. The assembly as claimed in claim 2, wherein the second hinge member comprises a pair of spaced spring clips and said back plate extends between the outer legs of said spring clips.

4. The assembly as claimed in claim 1, wherein said first hinge member comprises a flat hinge plate having openings for receiving fasteners for securing the plate to a side wall of a lid, the plate having an inner edge and an outer edge.

5. The assembly as claimed in claim 4, wherein said second hinge member includes a flange projecting transversely outwardly from said outer leg, and said hinge joint pivotally connects an outer edge of said flange to the outer edge of said hinge plate.

6. A receptacle for holding items, comprising:

an upright enclosure for receiving items, the enclosure having a rim at its upper end defining an opening for access to the interior of the enclosure;

a lid for closing said opening, the lid having a flat top and downwardly depending skirt; and a releasable hinge assembly releasably hinging said lid to the rim of said enclosure for movement between a closed position covering said opening and an open position in which said opening is uncovered;

the hinge assembly comprising a first hinge member secured to the skirt of said lid, a second hinge member comprising at least one generally U-shaped spring clip for snap engagement over the rim of said opening, and a hinge joint pivotally connecting said first hinge member to said second hinge member.

7. The receptacle as claimed in claim 6, wherein the skirt of the lid and the rim of said opening each have a corresponding rear side, the first hinge member being secured to the inner face of the rear side of said lid skirt and the second hinge member being engaged over the rear side of said rim, the spring clip having an inner leg and an outer leg, the second hinge member having a back plate projecting downwardly from the outer leg of said spring clip on the outside of said enclosure, and the rear side of said skirt having a lower edge comprising means for bearing against said back plate in the open position to hold the lid in the open position.

8. The receptacle as claimed in claim 6, wherein said spring clip has an inner leg and an outer leg, said second hinge member including a back plate depending downwardly from said outer leg on the outside of said enclosure for bearing on said enclosure to prevent rotation of said spring clip around said rim.

9. The receptacle as claimed in claim 8, wherein the second hinge member comprises a pair of spaced spring clips for engagement over said rim, and said back plate extends between the outer legs of said spring clips.

10. The receptacle as claimed in claim 6, wherein said spring clip has an inner leg and an outer leg, and a flange projecting transversely outwardly from said outer leg, said hinge joint pivotally connecting the outer edge of said flange to said first hinge member.

11. The receptacle as claimed in claim 10, wherein the hinge member is secured to said lid skirt at a predetermined distance inset from a lower edge of said lid skirt, said predetermined distance being substantially equal to the height of said flange.

* * * * *